US007814684B1

(12) United States Patent
Seward

(10) Patent No.: US 7,814,684 B1
(45) Date of Patent: Oct. 19, 2010

(54) SHOE INSOLE APPARATUS

(76) Inventor: Stephen W. Seward, 1519 Fm Road 3417, Mt. Pleasant, TX (US) 75455

( * ) Notice: Subject to any disclaimer, the term of this patent is extended or adjusted under 35 U.S.C. 154(b) by 693 days.

(21) Appl. No.: 11/754,681

(22) Filed: May 29, 2007

(51) Int. Cl.
*A43B 19/00* (2006.01)
*A43B 13/38* (2006.01)

(52) U.S. Cl. ..... 36/71; 36/44; 36/180

(58) Field of Classification Search ..... 36/71, 36/44, 180, 142–144, 174, 178, 153, 154
See application file for complete search history.

(56) References Cited

U.S. PATENT DOCUMENTS

| | | | | |
|---|---|---|---|---|
| 921,592 | A | 5/1909 | Cole | |
| 1,175,718 | A | 3/1916 | Crowe | |
| 2,261,041 | A | 10/1941 | Tennant | |
| 2,537,823 | A | 3/1947 | Gates | |
| 2,423,622 | A * | 7/1947 | Samblanet | 36/176 |
| 3,987,559 | A | 10/1976 | Roberts | |
| 4,333,472 | A * | 6/1982 | Tager | 36/140 |
| 4,583,303 | A | 4/1986 | Laiacona et al. | |
| 5,533,278 | A * | 7/1996 | Stein | 36/11.5 |
| 6,170,176 | B1 * | 1/2001 | Clough | 36/140 |
| 6,182,380 | B1 * | 2/2001 | Liley | 36/71 |
| D443,694 | S | 6/2001 | Ford | |
| 6,412,198 | B1 * | 7/2002 | Rothbart | 36/144 |
| 6,694,648 | B2 * | 2/2004 | Eriksen | 36/145 |
| 2004/0025377 | A1 * | 2/2004 | Brannon | 36/59 R |
| 2006/0236563 | A1 * | 10/2006 | Wang | 36/29 |
| 2006/0254092 | A1 * | 11/2006 | Stevens | 36/71 |

* cited by examiner

*Primary Examiner*—Ted Kavanaugh

(57) ABSTRACT

A shoe insole apparatus includes a panel that has a top side, a bottom side and a peripheral edge. The panel has a shape for being positioned within a shoe. The panel includes a front edge, a back edge, a first lateral edge and a second lateral edge. A cushion member is positioned adjacent to the first lateral edge and the front edge. The cushion member is positioned between the top and bottom sides. The cushion member is resiliently compressible. The cushion member extends between 1 inch and 3 inches toward the back edge along the first lateral edge. The panel is positioned within a shoe.

1 Claim, 4 Drawing Sheets

SHOE INSOLE APPARATUS

BACKGROUND OF THE INVENTION

1. Field of the Invention

The present invention relates to shoe insole devices and more particularly pertains to a new shoe insole device for preventing reducing pain and discomfort due to a bunion.

2. Description of the Prior Art

The use of shoe insole devices is known in the prior art. While these devices fulfill their respective, particular objectives and requirements, the need remains for a device that can be positioned within a shoe to prevent first metatarsal phalangeal joint, or large toe, of a person from rubbing against the wall of a shoe. The device should include means to prevent discomfort for the adjacent toes.

SUMMARY OF THE INVENTION

The present invention meets the needs presented above by generally comprises a panel that has a top side, a bottom side and a peripheral edge. The panel has a shape for being positioned within a shoe. The panel includes a front edge, a back edge, a first lateral edge and a second lateral edge. A cushion member is positioned adjacent to the first lateral edge and the front edge. The cushion member is positioned between the top and bottom sides. The cushion member is resiliently compressible. The cushion member extends between 1 inch and 3 inches toward the back edge along the first lateral edge. The panel is positioned within a shoe.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
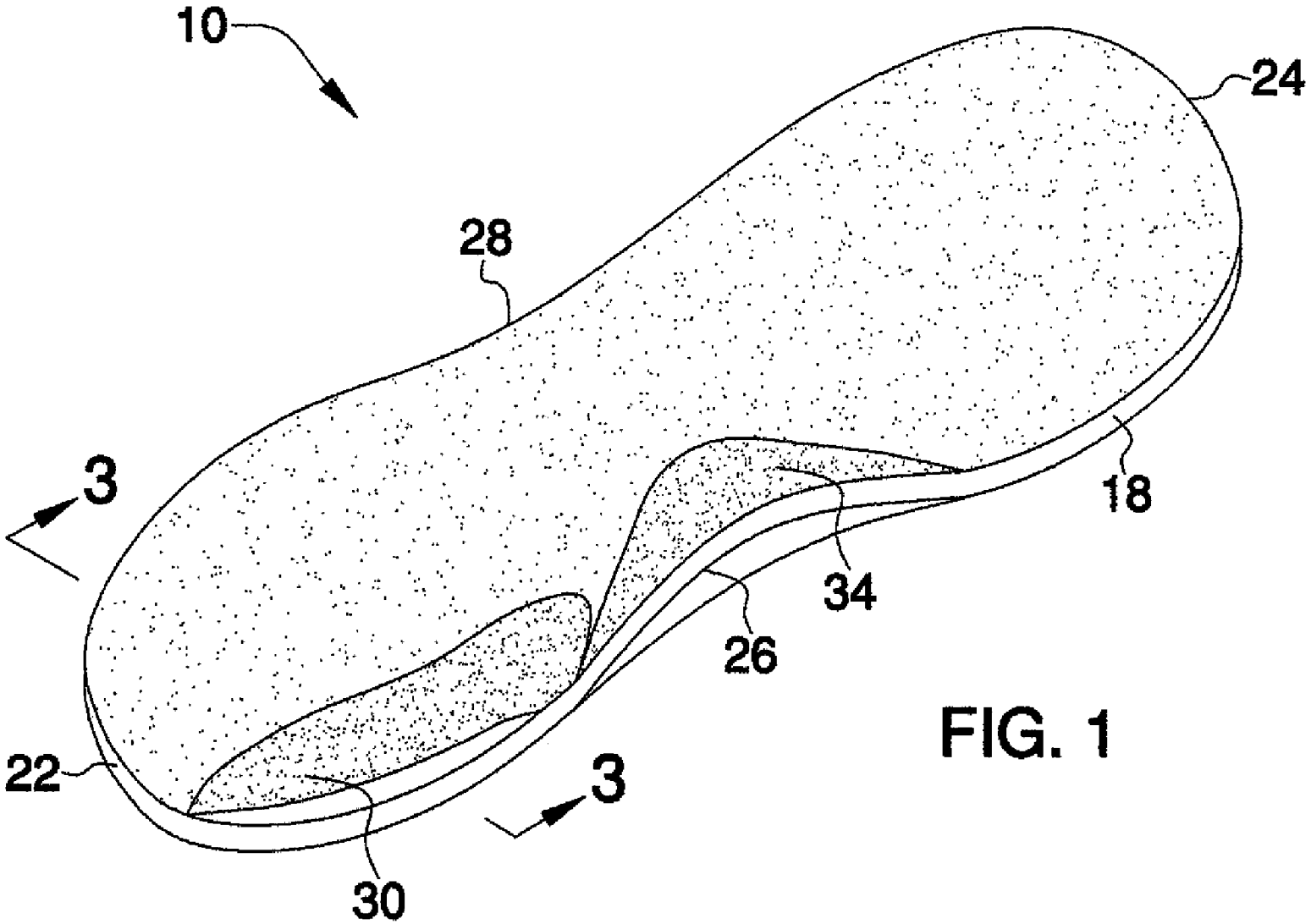
FIG. 1 is a perspective top view of a shoe insole apparatus according to the present invention.
Figure 2:
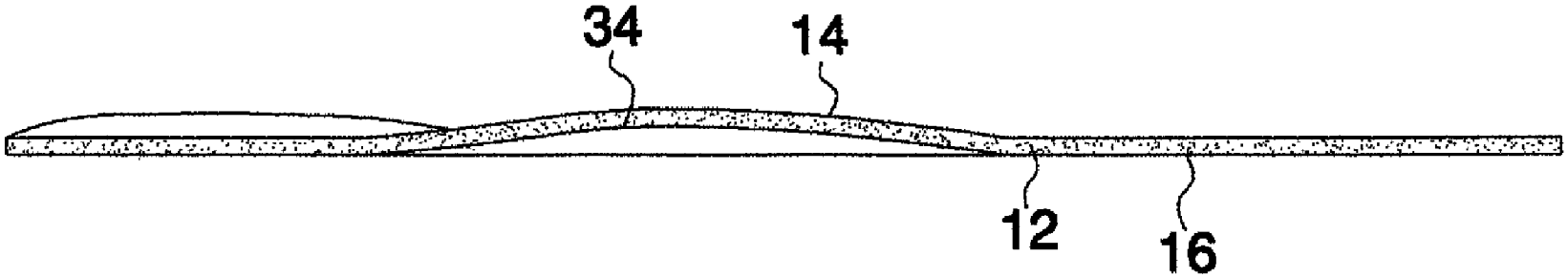
FIG. 2 is a side view of the present invention.
Figure 3:
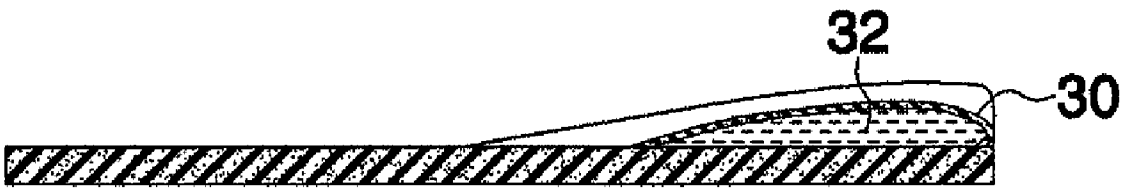
FIG. 3 is a cross-sectional view taken along line 3-3 of FIG. 1 of the present invention.
Figure 4:
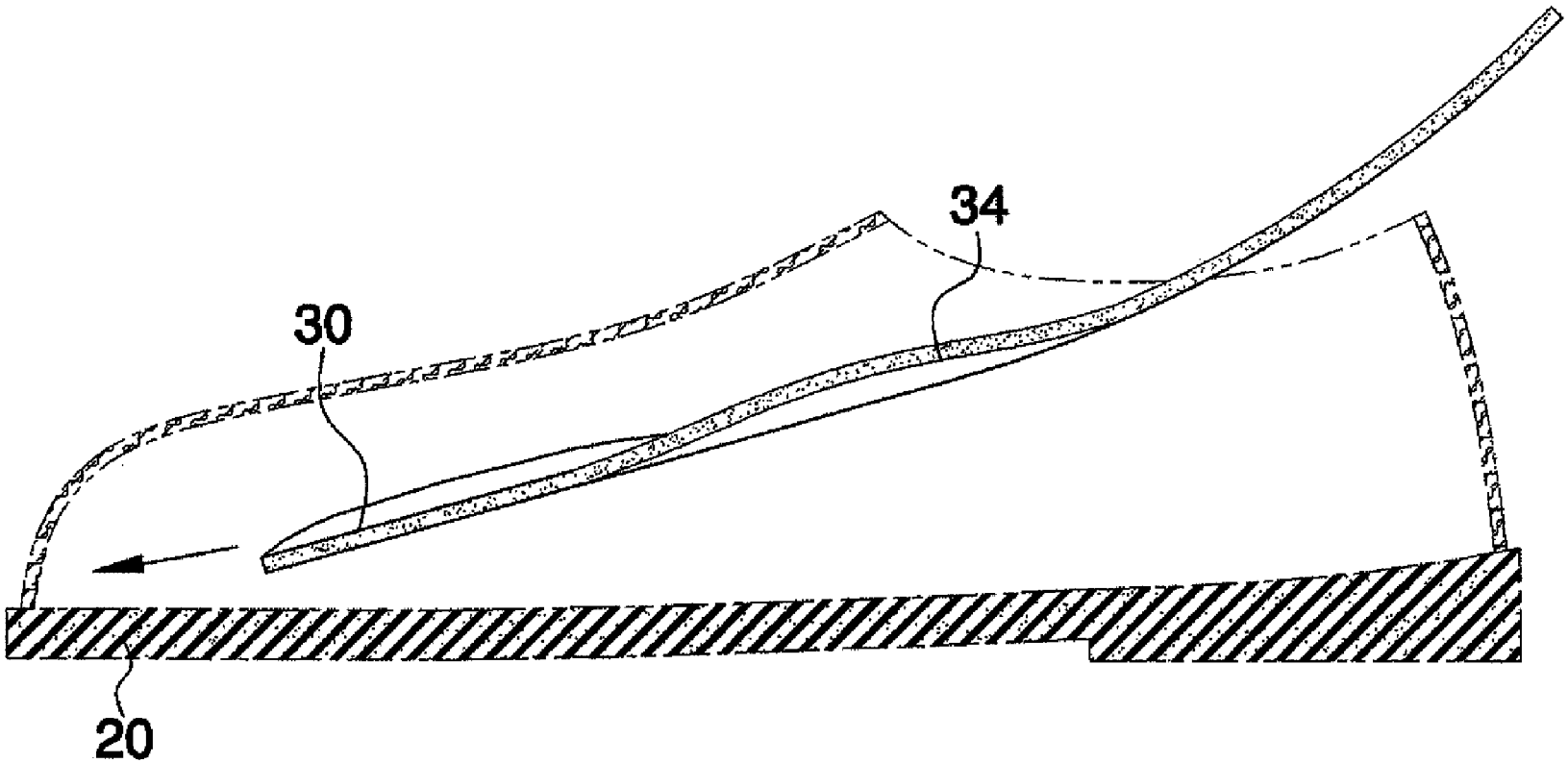
FIG. 4 is a side in-use view of the present invention.
Figure 5:
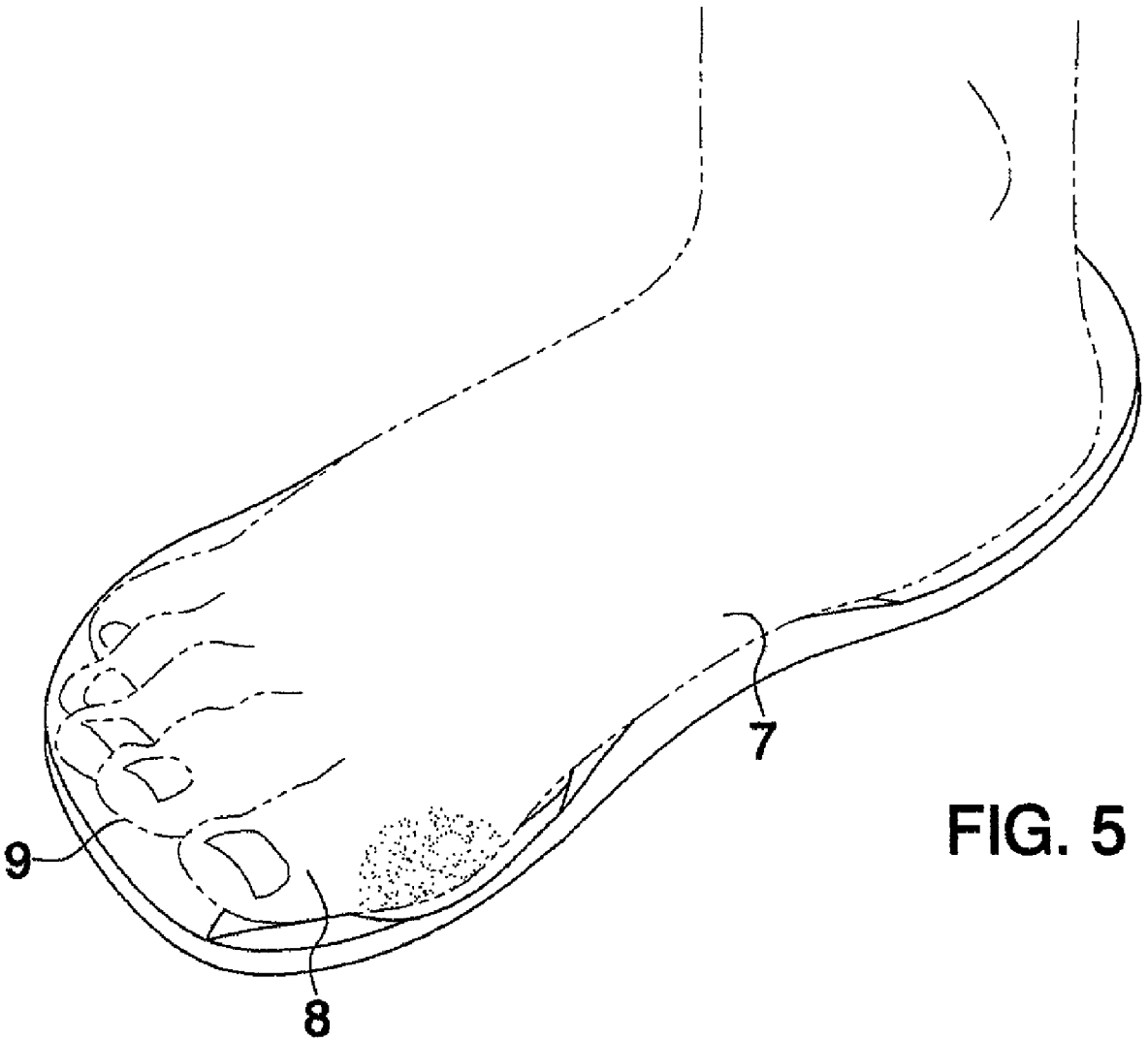
FIG. 5 is a top perspective in-use view of the present invention.

With reference now to the drawings, and in particular to FIGS. 1 through 5 thereof, a new shoe insole device embodying the principles and concepts of the present invention and generally designated by the reference numeral 10 will be described.

As best illustrated in FIGS. 1 through 5, the shoe insole apparatus 10 generally comprises a panel 12 that has a top side 14, a bottom side 16 and a peripheral edge 18. The panel 12 has a shape for being positioned within a shoe 20. The panel 12 includes a front edge 22, a back edge 24, a first lateral edge 26 and a second lateral edge 28.

A cushion member 30 is positioned adjacent to the first lateral edge 26 and the front edge 22. The cushion member 30 is positioned between the top 14 and bottom 16 sides. The cushion member 30 is resiliently compressible. The cushion member 30 extends between 1 inch and 3 inches toward the back edge 24 along the first lateral edge 26. The cushion member 30 extends between ½ inch and 1 inch toward the second lateral edge 28. The cushion member 30 has a height dimension. The height dimension 30 decreases from the first lateral edge 26 to the second lateral edge 28 to provide maximum support to a first metatarsal phalangeal joint 8 and minimum support to a second metatarsal phalangeal joint 9. The height dimension has a greatest height between ⅛ inch and ⅓ inch. The cushion member 30 comprises a pocket that is filled with a gel material 32.

An arch support 34 is positioned in the panel 12 between the top 14 and bottom 16 sides. The arch support 34 is positioned adjacent to the first lateral edge 26 and between the cushion member 30 and the back edge 24. The arch support 34 provides support of an arch of a foot 7.

In use, the panel 12 is positioned within the shoe 20. The person places their foot 7 into the shoe and onto the panel 12. The cushion member 30 prevents the first metatarsal phalangeal joint 8 from moving toward the first lateral edge 26 and thereby prevents pressure on the first metatarsal phalangeal joint 8 from a wall of the shoe 20. The gradual decreasing of the height dimension provides a more natural and comfortable feel for the user.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. An insole apparatus to prevent pressure on a bunion, said apparatus comprising:

a panel having a top side, a bottom side and a peripheral edge, said panel having a shape for being positioned within a shoe, said panel including a front edge, a back edge, a first lateral edge and a second lateral edge, said second lateral edge defining a medial edge of said panel;

a cushion member being positioned adjacent to said first lateral edge and said front edge, said cushion member being positioned between said top and bottom sides, said cushion member being resiliently compressible, said cushion member extending between 1 inch and 3 inches toward said back edge along said first lateral edge, said cushion member extending between ½ inch and 1 inch toward said second lateral edge, said cushion member having a height dimension, said height dimension decreasing from said first lateral edge to said second lateral edge to provide maximum support to a first metatarsal phalangeal joint and minimum support to a second metatarsal phalangeal joint, said cushion member comprising a pocket being filled with a gel material, said panel having a greater width and length than said cushion, said panel having a length dimension from said front edge to said back edge greater than at least two times a length of said cushion member, said cushion member being spaced from said second lateral edge, said cushion member abutting said first lateral edge;

an arch support being positioned in said panel between said top and bottom sides, said arch support being positioned adjacent to said first lateral edge and between said cushion member and said back edge; and wherein the panel is positioned within a shoe.

* * * * *